United States Patent [19]

Appleton

[11] Patent Number: 4,578,906

[45] Date of Patent: Apr. 1, 1986

[54] GRINDING TOOL

[75] Inventor: Cuthbert C. Appleton, Wokingham, United Kingdom

[73] Assignee: Seco Engineering Co., Ltd., England

[21] Appl. No.: 668,806

[22] Filed: Nov. 6, 1984

[30] Foreign Application Priority Data

Nov. 8, 1983 [GB] United Kingdom ..... 8329744

[51] Int. Cl.[4] ..... B24B 23/06

[52] U.S. Cl. ..... 51/170 EB; 51/135 BT; 51/148

[58] Field of Search ..... 51/170 R, 170 EB, 135 BT, 51/148

[56] References Cited

U.S. PATENT DOCUMENTS 3,611,646 10/1971 Cameron et al. ..... 51/148
3,643,385 2/1972 Mikiya ..... 51/170 EB
3,713,255 1/1973 Welsch ..... 51/170 EB

FOREIGN PATENT DOCUMENTS 1473564 5/1977 United Kingdom .

OTHER PUBLICATIONS

European Search Report, EP 84307682.9, 1/28/85.

*Primary Examiner*—Roscoe V. Parker
*Attorney, Agent, or Firm*—Lowe, King, Price & Becker

[57] ABSTRACT

A grinding tool comprises an endless abrasive belt looped around a drive pulley 2 and an idler pulley 23 and straddling therebetween a first arm 6 and a second arm 18. Tension is maintained in the belt by biasing element 10 acting on an end of the first arm. The first arm 6 is mounted in a slide assembly 4 which includes elements 5,7,8 for preventing the arm from sliding back into the assembly in use. The second arm 18 is pivotally mounted in a tracking head assembly 14 on an end of the first arm 6, with lateral biasing elements 16, 17 acting on respective opposing sides of the end portion of the second arm 18. This permits tilting of the idler pulley 23 to obtain correct tracking of the belt, and enables the arm 18 and the belt to be rapidly and easily changed.

6 Claims, 3 Drawing Figures

GRINDING TOOL

This invention relates to a grinding tool, and more particularly to a belt grinder. The invention is especially adapted for hand held grinders which use coated abrasive, diamond and abrasive impregnated endless belts as the grinding medium. The invention is also suitable for similar grinders fitted with wheels, skids or the like to allow the machine to be moved over the surface of a work piece.

GB-A 1473564 describes a hand tood grinding device, which comprises a housing containing a drive wheel, an arm extending from the housing and having an idler pulley at its end, and an endless abrasive belt looped around the idler pulley, straddling the arm, and driven by the drive wheel. A pair of direction-change pulleys are mounted in the housing, to cause the flights of the belt to undergo two 90° twists between the idler pulley and the drive wheel. Tension is maintained in the belt by pivoting the arm from within the housing against a spring bias. Tracking of the belt around the idler pulley is achieved by forming the arm in two parts, one being pivotable relative to the other against a spring bias.

With tools of this kind, it is frequently required to change the arm, or the arm part which mounts the idler pulley, and/or to change the belt. This is because different kinds of work require different widths or surfaces of the abrasive belt, and different lengths or shapes of the arm. Belts are therefore provided in a wide variety of surfaces, widths and lengths, with corresponding arms and idler pulleys. It is therefore most desirable that an arm can be changed rapidly, and that accurate tracking of a new belt can be readily achieved. The arm design in GB-A 1473564 is not entirely satisfactory in this respect. A further difficulty is caused when, in use, substantial pressure is applied to the belt, either against the idler pulley or against a platen on the side of the arm. Such pressure causes slipping of the belt, with greatly increased wear in the belt and the drive wheel.

The present invention provides a belt grinder comprising a slide assembly having defined therein an elongated channel; a first elongated arm slidably mounted in said elongated channel such that an end of the arm protrudes from the channel; a belt-driving wheel on the side of the slide assembly remote from the protruding end of the first arm; drive means for driving said belt-driving wheel; a collar fixedly mounted on the said protruding end of the first arm and defining therein a receiving channel colinear with the arm; a second elongated arm having an end portion received in the receiving channel of the collar such that the second arm is substantially colinear with the first arm; an idler pulley mounted on the end of the second arm remote from the first arm and having its axis of rotation extending transversely of the second arm; an endless abrasive-surface belt supported by the belt-driving wheel and the idler pulley and straddling the arms therebetween; end biasing means acting on the end of the first arm within the elongated channel and urging the arm to protrude from the channel, thereby to maintain tension in the belt; blocking means for preventing the first arm from sliding into the elongated channel against the end biasing means; pivot means cooperating on the second arm and the collar to permit slight pivoting of the second arm relative to the first arm in a plane which includes the axis of rotation of the idler pulley, and is parallel to the arms, thereby to tilt said axis for maintaining accurate tracking of the belt; and lateral biasing means acting on respective opposing sides of the end portion of the second arm within the collar and tending to oppose said pivoting.

The pivot means preferably comprise a pivot pin on the second arm or the collar, the pin being perpendicular to the axis of the idler pulley, and engaging with a slot in the collar or the second arm respectively.

The lateral biasing means preferably comprise two leaf springs mounted on opposite inner surfaces of the collar and acting on the adjacent opposing surfaces of the second arm. Screw means are preferably provided for adjusting the tension in one or both of the leaf springs, so as to permit accurate tracking of the belt.

Blocking means are provided for allowing the spring loaded first arm, which provides the tension on the loop of abrasive-coated belt, to move only forward out of the elongated channel in the slide assembly, and not backward into the slide assembly. Backward movement does, of course, allow slackening of the tension on the belt, which is undesirable. A tapered channel is defined between adjacent relative sliding surfaces of the first arm and the slide assembly. A blocking member, preferably a roller or a ball, is accommodated in this tapered channel and is urged by a spring towards the tapered end. The arrangement is such that the relative sliding surfaces tend to carry the blocking member away from the tapered end of the channel when the first arm slides forward, so the blocking member does not afford any resistance to this forward movement. However, when it is attempted to move the first arm backwards into the housing, the relative sliding surfaces tend to carry the blocking member towards the tapered end of the channel, and this therefore blocks such backward movement. Means are preferably provided for holding the blocking member against the spring and away from the tapered end, to permit the first arm to be moved backward into the slide assembly for changing the belt and/or the second arm.

Reference is now made to the accompanying drawings, in which.

Figures 1, 2, 3:
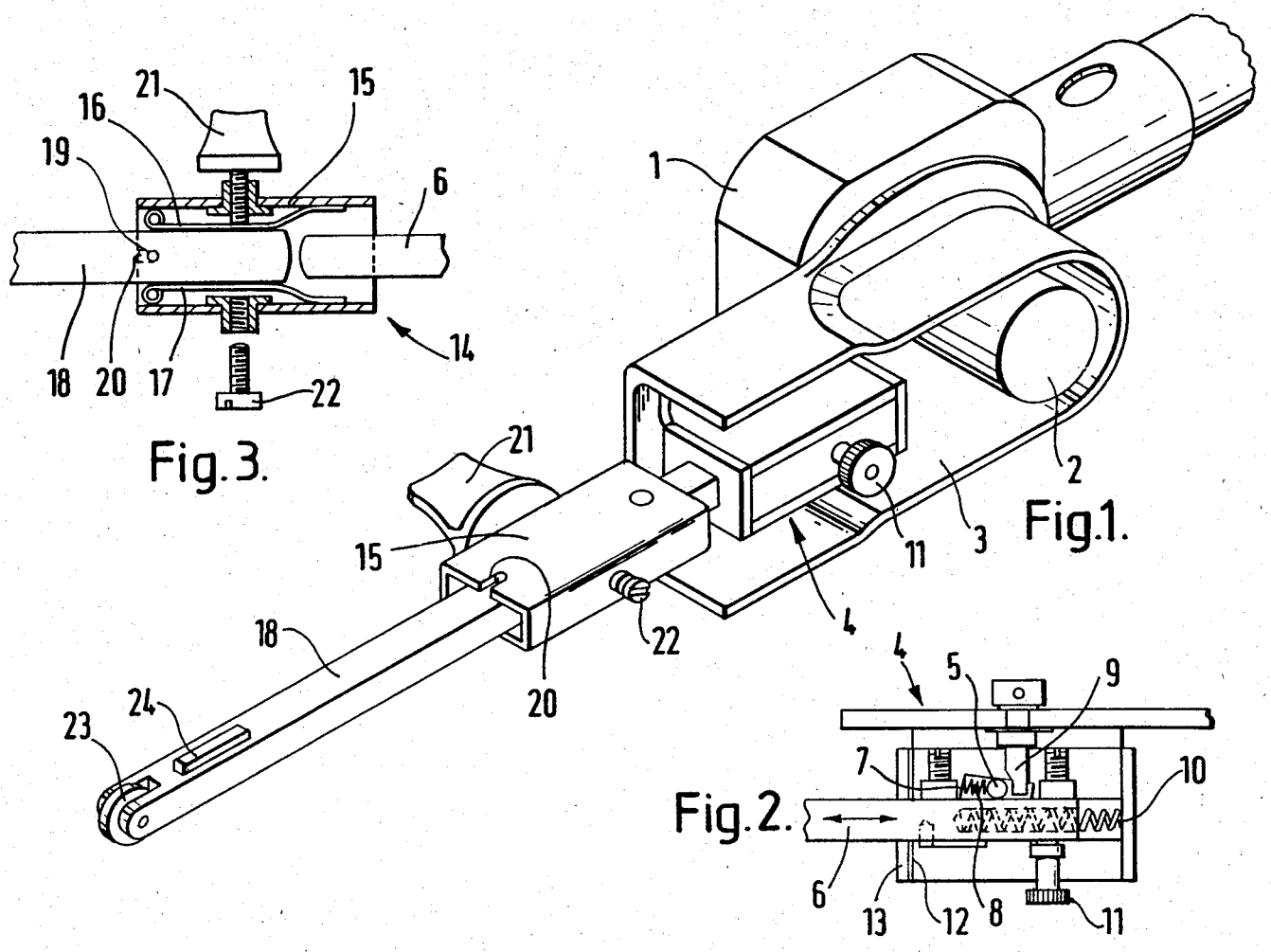
FIG. 1 is a perspective view of a belt grinder according to an embodiment of the invention.
FIG. 2 is a partial plan view of the rear slide assembly of the same tool.
FIG. 3 is a partial plan view of the tracking head assembly of the same tool.

The tool includes a housing 3 which accommodates a belt-driving pulley 2, which is driven by a motor 1 on the side of the housing or a flexible drive head. The housing accommodates a slide assembly 4 which includes an elongated channel and a first elongated arm 6 which is slidable in the channel and protrudes therefrom.

The arm 6 can generally slide backwards and forwards within the channel in the slide assembly. It is urged in the forward direction, e.g. in which it tends to protrude more from the channel, by means of a helical compression spring 10 disposed between a bore in the internal end of the arm and the closed end of the channel. As will become apparent , this spring maintains the tension in the abrasive belt. Means are provided to allow forward movement of the arm 6 in the channel but generally to block backward movement. For this purpose, a tapered channel 7 is defined between the flat side of the arm 6 and the side of the main channel in the slide assembly. The tapered end of the channel 7 is directed backwards. Accommodated in this tapered channel is a roller 5 which is urged by a spring 8 towards the tapered end of the channel. When the arm 6 is moved forward, the roller 5 tends to be carried away from the enclosing sides of the tapered channel, and therefore does not resist such movement. If it is attempted to move the arm 6 backwards, then the roller 5 tends to be carried towards the tapered end of the channel, and then jams between the taper and the sliding surface of the arm, thus blocking such backward movement. In case it is desired to override this blocking action, an engage/disengage bar 9 with a cut-away end portion is provided adjacent the roller 5. This bar can be used to hold the roller 5 back against the spring 8, so that it no longer acts as a blocking member.

The roller 5 described above can be equally effectively replaced by more than one such roller, or by one or more balls, or even by a wedge shaped member which can be used to cause jamming between the arm 6 and the channel in the slide assembly. The tapered channel 7 can also equally effectively be located on the sliding arm 6 itself, thereby enabling jamming of a suitable blocking member inserted between the arm 6 and the channel in the slide assembly. Furthermore, one or more inserts can be used between the taper and the roller or other blocking member.

A spring loaded pin 11 is mounted in a transverse bore in the slide assembly and can be inserted into a recess in the sliding arm 6 to retain the arm in its rear position, thus facilitating the changing of the endless abrasive belts as described below. In this position, the pin 11 is held in the recess by the indirect pressure of the spring 10. This pressure is released when the arm 6 is moved slightly further back and the pin 11 is then automatically retracted, enabling the arm 6 to be urged forward again by the spring 10. A seal 12 for the slide assembly is held in place by a plate 13. This seal prevents the entry of dirt and dust etc into the slide assembly.

At the end of the sliding arm 6 remote from the spring 10 there is fixed a tracking head assembly 14 which is generally in the form of a collar. This is fixed so that it cannot move relative to the arm 6. The tracking head consists of a rectangular casing 15 defining therein a receiving channel colinear with the arm 6. A removable second arm 18 is received in this channel so that the two arms are substantially colinear with a gap between their adjacent ends. Leaf springs 16 and 17 are fixed into the tracking head 14 assembly by means of pins located in the top and bottom faces of the casing 15 and inserted through loops or eyes formed at the ends of the springs. The springs then pivot on these pins. When the arm 18 is not fitted into the assembly 14 and the two springs can move freely as they are a loose fit over the pins inserted through the eyes. The springs are prevented from fouling one another due to the fact that the free ends come up against the outside faces of the arm 6. On inserting the arm 18 into the assembly 14 the springs are pushed outwards, towards the sides of the casing 15 as shown in FIG. 3, and they provide side pressure on opposing side surfaces near the end of the arm 18. To ensure accurate placing and adjustment of the arm 18, a pin 19 protects transversely from the top and bottom surfaces of the arm 18 and is located in slots 20 in the casing, thus providing a location and pivot point.

At the end of the arm 18 remote from the tracking head assembly 14 there is mounted an idler pulley 23 having its axis of rotation extending transversely of the arm 18, substantially normal to the springs 16 and 17, and substantially parallel to the axis of the drive pulley 2. An endless abrasive surface belt is looped around the belt driving pulley 2 and the idler pulley 23 and straddles the two arms 6 and 18 therebetween. Tension is generally maintained in the belt by means of the spring 10, which tends to urge the two arms, and hence the idler pulley, away from the driving pulley.

A threaded screw 21 passes through a corresponding threaded hole in the side of the casing 15 and is used to exert pressure against the spring 16. This pressure urges the spring against the arm 18 which is in turn moved on its pivot point 19. The pivot provided by the pin 19 and slot 20 permits slight pivoting of the arm 18 relative to the arm 6, in a plane which includes the axis of rotation of the idler pulley 23 and is parallel to the arms thereby to tilt this axis for obtaining accurate tracking of the belt. The arm 18 is held between the springs 16 and 17, the inward pressure of the adjusted spring 16 being balanced by the inward pressure of the spring 17.

The arrangements described above ensure correct tracking of the abrasive belt in the course of use. Wear on the belt tends to cause lengthening thereof, and such lengthening is not necessarily constant over the whole width of the belt. Frequently the wear is greatest towards the edge of the belt, and lengthening is correspondingly greatest in this region. General lengthening of the belt is accommodated by means of the spring 10, which ensures that the belt is generally held under tension even when it is lengthened in use. Increased lengthening of the belt in the edge region thereof is accommodated by means of the tilting of the axis of the idler pulley as described above. This adjustment also allows belt to be moved so that is overhangs one side of the idler pulley more than the other, which is useful in certain applications.

In the case of doing work that will exert more than usual side pressure on the arm 18, a further screw 22 is provided in addition to and on the opposite side of the casing to the screw 21. This further screw 22 exerts pressure on the spring 17, locking the arm 18 in the desired position.

The arm 18 is an interchangeable part of the tool. The tracking head assembly 14 described above permits quicker and easier changing of the arm 18 compared with previous designs. In order to change an arm 18, the bar 9 is first turned to immobilise the locking member 5. The arm assembly is then pushed into the housing against the spring 10, and locked in this position by means of the spring loaded pin 11 which is located in the recess in the arm 6. In this position, the abrasive belt is loose and can easily be removed from the pulleys, and the interchangeable arm 18 is then simply pulled out of the tracking head assembly 14. A new arm 18 is then inserted, the pin 19 being located in the slots 20, and a corresponding belt is positioned over the pulleys. The pin 11 is released by simply pushing the arm 18 further to the rear, whereby the spring on the pin 11 withdraws it from the recess in the arm 6. The bar 9 is then turned to release the locking member 5. Initial adjustment is achieved by unscrewing the locking screw 22, and turning the screw 21 to cause the arm 18 to move. The arm is then locked in the desired position by tightening the screw 22 against the spring 17, if necessary, thus achieving a rigid assembly between the arm 18 and the arm 6, through the various components of the head assembly 14, which is firmly located in relation to the sliding arm 6.

Depending on the grinding work to be carried out, abrasive belts having different abrasive surfaces and/or different widths may be needed. Different widths of belt will require idler pulleys 23 of different sizes. The idler pulley is generally fixed to the arm 18, to changing the belt width will mean changing the arm 18. Furthermore, the arms 18 will be provided in different lengths, different shapes and with different shapes and sizes of idler wheels for various applications, and these will require belts of corresponding length. A further variable is the nature of the platen 24 which is mounted towards the end of the arm 18 under the belt flight. Grinding may be carried out as the belt passes over the idler wheel 23 or as it passes over the platen 24. The platens themselves may be of different materials e.g. PTFE or steel, with different degrees of resilience. Grinding is best carried out on the return flight of the belt as this gives greater control to the operator. These numerous possibilities enable the flexibility of the machine to be exploited, but it is essential for this that the changing of the arm 18 be a rapid and easy operation. The arrangement according to the invention clearly achieves this object.

If grinding is being carried out over the platens, it can be advantageous to have two or more different platens on the same arm, on opposite sides to achieve different finishes on the workpiece. As grinding is best carried out in the return flight, the arm 18 simply has to be removed and replaced after twisting through 180° to change from one platen to the other. In machines where the arm is not reversible in this respect, e.g. in GB-A 1473564, two different arms would be required for work with two different platens, or the platens would have to be removed and replaced on the arms, which can be difficult and time-containing. Alternatively, grinding could be carried out over a platen on the outward flight of the belt, but as has been shown this is not so convenient for the operator.

The roller mechanism 5 in the present invention ensures that belt tension is kept constant, even when considerable pressure is applied during grinding. This is because the arms are prevented during use from moving back into the slide assembly. Loosening of the belt therefore does not occur in practice.

In the preferred embodiment the pulleys 2 and 23 are parallel. There is therefore no twisting of the belt, which contributes to wear, and direction-change pulleys are disensed with.

For heavy duty use, a support member can be fixed to the housing 3, said member providing lateral support for the arm 18, through a bracket between the support member and the arm 18, fixed to one member and sliding on the other.

I claim:

1. A belt grinder comprising a slide assembly having defined therein an elongated channel; a first elongated arm slidably mounted in said elongated channel such that an end of the arm protrudes from the channel; a belt-driving pulley on the side of the slide assembly remote from the protruding end of the first arm; drive means for driving said belt-driving pulley; a collar fixedly mounted on the said protruding end of the first arm and defining therein a receiving channel colinear with the arm; a second elongated arm having an end portion received in the receiving channel of the collar such that the second arm is substantially colinear with the first arm; an idler pulley mounted on the end of the second arm remote from the first arm and having its axis of rotation extending transversely of the second arm; an endless abrasive-surface belt supported by the belt-driving pulley and the idler pulley and straddling the arms therebetween; end biasing means acting on the end of the first arm within the elongated channel and urging the arm to protrude from the channel, thereby to maintain tension in the belt; blocking means for preventing the first arm from sliding into the elongated channel against the end biosing means; pivot means cooperating on the second arm and the collar to permit slight pivoting of the second arm relative to the first arm in a plane which includes the axis of rotation of the idler pulley, and is parallel to the arms, thereby to tilt said axis for maintaining accurate tracking of the belt; and lateral biasing means acting on respective opposing sides of the end portion of the second arm within the collar and tending to oppose said pivoting.

2. A belt grinder according to claim 1, wherein the pivot means comprise a pivot pin on the second arm or the collar, said pin being perpendicular to the axis of the idler pulley, and engaging with a slot in the collar or the second arm respectively.

3. A belt grinder according to claim 2, wherein the lateral biasing means comprise two leaf springs mounted on opposite inner surfaces of the collar and acting on the adjacent opposing surfaces of the second arm.

4. A belt grinder according to claim 3, wherein screw means are provided for adjusting the tension in one or both of the leaf springs, so as to permit accurate tracking of the belt.

5. A belt grinder according to claim 1, wherein the blocking means comprise a tapered channel defined between adjacent relative sliding surfaces of the first arm and the slide assembly, and a blocking member accommodated in this tapered channel and urged by a spring towards the tapered end, such that the relative sliding surfaces tend to carry the blocking member away from the tapered end when the first arm slides forward, but tend to carry the blocking member towards the tapered end to jam the relative sliding surfaces when the first arm moves backward into the slide assembly.

6. A belt grinder according to claim 5, comprising means for holding the blocking member against the spring and away from the tapered end, to permit the first arm to be moved backward into the slide assembly for changing the belt and/or the second arm.

* * * * *